US009035728B2

(12) United States Patent
Zienkewicz et al.

(10) Patent No.: US 9,035,728 B2
(45) Date of Patent: May 19, 2015

(54) ELECTROMAGNETIC INTERFACE SECURED BY USING AN INDIRECT COMPRESSION FORCE TO SLIDABLY ENGAGE FIRST AND SECOND FORCE TRANSFER FEATURES

(71) Applicant: ViaSat, Inc., Carlsbad, CA (US)

(72) Inventors: Rob Zienkewicz, Chandler, AZ (US); Mike Potemra, Chandler, AZ (US)

(73) Assignee: ViaSat, Inc., Carlsbad, CA (US)

( * ) Notice: Subject to any disclaimer, the term of this patent is extended or adjusted under 35 U.S.C. 154(b) by 130 days.

(21) Appl. No.: 13/801,078

(22) Filed: Mar. 13, 2013

(65) Prior Publication Data

US 2014/0077903 A1 Mar. 20, 2014

Related U.S. Application Data

(60) Provisional application No. 61/701,470, filed on Sep. 14, 2012.

(51) Int. Cl.

| | |
|---|---|
| ***H01P 1/04*** | (2006.01) |
| ***H01P 5/00*** | (2006.01) |
| ***H01P 11/00*** | (2006.01) |
| ***H01P 5/02*** | (2006.01) |

(52) U.S. Cl.

CPC ..... *H01P 5/00* (2013.01); *H01P 11/001* (2013.01); *Y10T 29/49016* (2015.01); *H01P 1/042* (2013.01); *H01P 5/024* (2013.01)

(58) Field of Classification Search

CPC ..... H01P 1/042
USPC ..... 333/254, 255
See application file for complete search history.

(56) References Cited

U.S. PATENT DOCUMENTS

| | | | | |
|---|---|---|---|---|
| 3,390,901 | A * | 7/1968 | Bibb | 285/406 |
| 4,011,532 | A * | 3/1977 | Williams et al. | 333/254 |
| 2007/0252665 | A1 * | 11/2007 | Voss et al. | 333/254 |
| 2008/0303613 | A1 * | 12/2008 | Lau et al. | 333/254 |

* cited by examiner

*Primary Examiner* — Benny Lee
(74) *Attorney, Agent, or Firm* — Snell & Wilmer, L.L.P.

(57) ABSTRACT

In an example embodiment, an electromagnetic interface can comprise: a first component comprising a first waveguide channel, a first interface surface, and a first force transfer feature; a second component comprising a second waveguide channel, a second interface surface, and a second force transfer feature; and a fastener that can be configured to force the first force transfer feature in sliding engagement with the second force transfer feature. The first and second force transfer features can be configured to interoperate to create an indirect force holding the first interface surface in contact with the second interface surface and holding the first waveguide channel in alignment with the second waveguide channel.

22 Claims, 5 Drawing Sheets

ELECTROMAGNETIC INTERFACE SECURED BY USING AN INDIRECT COMPRESSION FORCE TO SLIDABLY ENGAGE FIRST AND SECOND FORCE TRANSFER FEATURES

This application claims priority to U.S. Provisional Application No. 61/701,470, entitled "Electromagnetic Interface Using Indirect Compression Force," which was filed on Sep. 14, 2012, the contents of which are hereby incorporated by reference for any purpose in their entirety.

FIELD

This application is relevant to the field of radio frequency waveguide interface technology, and particularly to low voltage standing wave ratio interfaces.

BACKGROUND

In many radio frequency ("RF") devices, an RF waveguide in a first metal piece can be connected to an RF waveguide in a second metal piece. The connection can also be described as an electromagnetic interface. It may be desirable that this electromagnetic interface be a low Voltage Standing Wave Ratio ("VSWR") interface. In order to have such a low VSWR interface, it can be advantageous to have uniform contact between the interfacing surfaces of the two metal pieces. With reference to FIG. 1, an electromagnetic interface can be formed between a first metal piece 110 and a second metal piece 120. Although described herein as first and second metal pieces, the first metal piece can more generally be a component, and the second metal piece can more generally be a component, to the extent that these components each comprise a waveguide channel. Thus, an electromagnetic interface can be formed between a first component 110 and a second component 120.

The electromagnetic interface between pieces 110 and 120 defines an interface plane. First metal piece 110 can comprise a waveguide channel 112 aligned in a first direction that can be perpendicular to the interface plane. The second metal piece 120 can comprise a waveguide channel 122 aligned in the first direction as well. The waveguide channels 112 and 122 can be aligned with each other. The first and second metal pieces can be held together by two or more screws 130 that pass through the first metal piece and screw into the second metal piece to keep the two metal pieces in tight contact one with another. In this manner, the two wave guide pieces can be directly fastened to each other. In such embodiments, electromagnetic chokes can be used to improve performance/reduce loss.

However, such direct compression techniques are not always possible due to space constraints, access needs, tool access needs, machining and manufacturing needs, material dimensions, and the like. Improved methods and designs are now described for indirect compression techniques.

In an example embodiment, an electromagnetic interface can comprise: a first component comprising a first waveguide channel, a first interface surface, and a first force transfer feature; a second component comprising a second waveguide channel, a second interface surface, and a second force transfer feature; and a fastener that can be configured to force the first force transfer feature in sliding engagement with the second force transfer feature. The first and second force transfer features can be configured to interoperate, to create an indirect force holding the first interface surface in contact with the second interface surface and holding the first waveguide channel in alignment with the second waveguide channel.

In another example embodiment, an electromagnetic interface can be configured to have a low voltage standing wave ratio at the electromagnetic interface between two components using an indirect force to engage the two components. The electromagnetic interface can comprise: a first force transfer feature in fixed spatial relationship with a first component of the two components; a second force transfer feature in fixed spatial relationship with a second component of the two components. The first force transfer feature and second force transfer feature can be configured to convert the indirect force in a first direction into a direct force in a second direction. The direct force in the second direction can cause the first component and the second component to be held together at their EM interface.

A method of connecting a waveguide to a chassis can comprise: forming a waveguide comprising a first force transfer feature; forming a chassis comprising a second force transfer feature; and applying an indirect compression force between the waveguide and the chassis. The indirect compression force can be translated through the first and second force transfer features to generate a compressive force that can hold the waveguide and chassis together at a waveguide interface.

BRIEF DESCRIPTION OF THE DRAWINGS

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
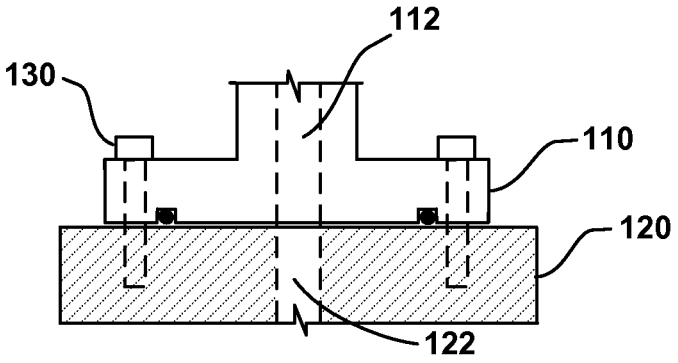
FIG. 1 Prior Art
FIG. 1 is a side view of a prior art waveguide to chassis interface.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used: the singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5. etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

As mentioned above, in the direct compression embodiments, the fasteners can be perpendicular to the interface between the two components being held together. Furthermore, in the direct compression embodiments, the fasteners can be parallel to the waveguides in the first and second metal pieces. In various embodiments, however, space constraints may not permit the use of fasteners that are perpendicular to the interface plane or parallel to the waveguides. In particular, it can be difficult or impossible to manipulate the fastener due to space constraints. For example, space constraints can make it difficult to position a screwdriver to tighten the screws holding the two metal pieces together. Further, after construction, it can be difficult to access the fasteners to take the two pieces apart for maintenance and the like. Moreover, in some designs, constraints related to machining and manufacturing can make it difficult to make a standard waveguide interface that employs direct compression techniques.

In addition, and with further reference to FIG. 1, in the direct compression techniques, the fasteners can be secured by screwing them into the second metal piece. In some instances, however, the second metal piece can be too thin to receive the fastener, and/or interfering components or waveguides can exist in the vicinity of where the fasteners might otherwise engage the second metal piece. Various solutions can comprise the use of metal shims to create the compressive forces. Other techniques used can include use of expensive machining techniques and electromagnetic chokes to reduce the VSWR at an interface so constructed.

Various example embodiments of a new electromagnetic (EM) interface can be configured for low VSWR at the EM interface between two metal pieces while using an indirect force to engage the two metal pieces. For example, the EM interface can be configured to apply a force to the first piece in a first direction that is not perpendicular to the interface plane and to cause the first metal piece to be forced in contact with the second metal piece at the interface. In one example embodiment, the force applied to the first metal piece can be a force in a direction that is parallel to the interface plane between the two metal pieces. In another example embodiment, the force can be applied by a threaded fastener that drives a wedge on the first metal piece into an opposite facing wedge on the second metal piece. In this manner, the opposing wedges can cause the first metal piece to be forced together with the second metal piece at the interface plane.

Figure 2:
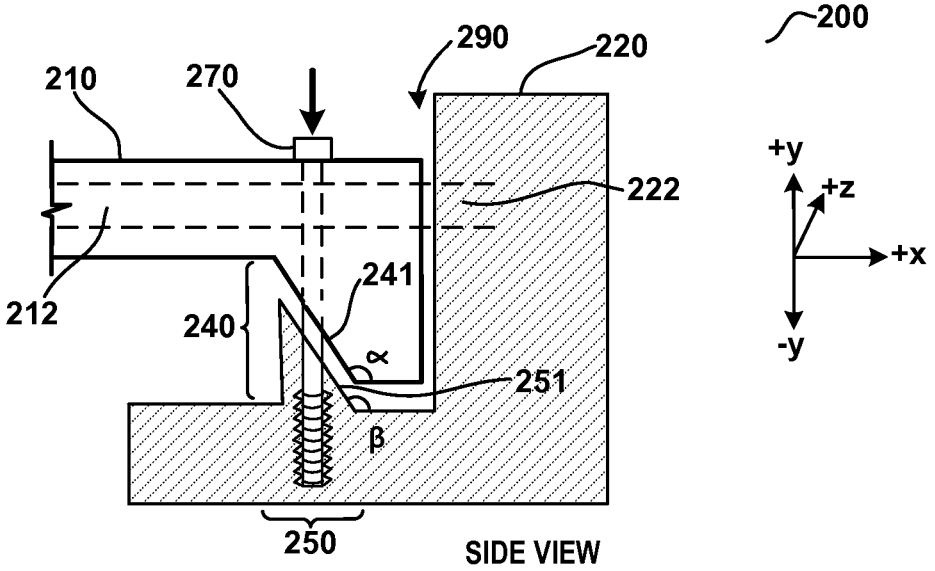
FIGS. 2-3 are respectively side and top views of an example interface in accordance with various example embodiments.

With reference now to FIG. 2, in an example embodiment, a low VSWR electromagnetic interface 200 can be configured to use an indirect compression force on the interface. The EM interface 200 can comprise a first metal piece 210 and a second metal piece 220. First metal piece 210 can comprise a first waveguide channel 212. Second metal piece 220 can comprise a second waveguide channel 222. The first waveguide channel can be configured to intersect a first interface surface of first metal piece 210. The second waveguide channel can be configured to intersect a mating interface surface on the second metal piece 220. The first and second waveguide channels can be oriented in their respective metal pieces such that causing the first and second metal pieces to be connected together can cause the waveguide channels, near the interface, to be substantially aligned.

The first interface surface and the mating interface surface can be configured to engage each other, under pressure, to form a low VSWR interface. Low VSWR can result, for example, from uniform contact created by proper machining and the application of pressure forcing the two pieces together at their interfaces. For example, a low VSWR interface at 20 GHz can have a VSWR, of less than 3:1 dB, less than 2:1 dB or less than 1.1:1 dB.

In one embodiment, first metal piece 210 can comprise a first wedge portion 240. The second metal piece can comprise a mating wedge portion 250. For ease of discussion, an XYZ coordinate system is illustrated in FIG. 2. In example embodiments, first wedge portion 240, can comprise a nub extending below the main portion of first metal piece 210. First wedge portion can be of any suitable height. In one example embodiment, the height (in the −Y direction) of first wedge portion 240 can be 0.080 inches, or any other suitable height. First wedge portion 240 can be of any suitable thickness in the X direction, wherein the term 'thickness' indicates the additional X direction material beyond that of the material in the triangular shaped wedge. In one example embodiment, the thickness of first wedge portion 240 can be 0.150 inches, or any other suitable thickness. Similarly, first wedge portion can be of any suitable depth in the Z direction. In one example embodiment, the depth of first wedge portion 240 can be 0.200 inches. Moreover, the first wedge portion can be of any suitable height, thickness, and depth suitable for withstanding the forces exerted against it.

Similarly the second wedge portion 250, in one example, can be a wedge shaped object extending from a support attached to second metal piece 220. Second wedge portion 250 can be of any suitable height. In one example embodiment, the height (in the +Y direction) of second wedge portion 250 can be 0.100 inches. Second wedge portion 250 can be of any suitable thickness in the X direction, wherein the term 'thickness' indicates the additional X direction material beyond that of the material in the triangular shaped wedge. In one example embodiment, the thickness of second wedge portion 250 can be 0.100 inches, or any other suitable thickness. Similarly, second wedge portion can be of any suitable depth in the Z direction. In one example embodiment, the depth of second wedge portion 250 can be 0.250 inches. Moreover, the second wedge portion can be of any suitable height, thickness, and depth to withstand the forces exerted against it.

Although described herein as wedge portions, generically, first wedge portion or second wedge portion can be described as "force transfer features." The force transfer features can comprise a structure with complementary sloped surfaces for transferring a force in a first direction into a force in a direction orthogonal to the first direction. Moreover, and with momentary reference to FIG. 7, one of the two wedges (wedge 951) can comprise a sloped surface, and the other wedge (952) can comprise a surface, a point, a rounded edge, or other force transfer feature shape that slides along the sloped surface. Thus, in an example embodiment, at least one of the force transfer features can comprise a surface that can be sloped relative to the electromagnetic interface. Moreover, the sloped surface can be "facing" a direction that can be outwardly normal to the sloped surface. In an example embodiment, the sloped surface of the first wedge faces in an opposite direction of a slopped surface of the second wedge.

In one example embodiment, the force transfer features can be integrated respectively in each of the first and second metal pieces 210/220. In other words, the first force transfer feature can be an integral part of first metal piece 210 and the second force transfer feature can be an integral part of second metal piece 220. In another example embodiment, the force transfer features can be separate force transfer components that can be attached to the first and second metal pieces respectively.

With further reference to FIG. 2, second wedge 250 can be configured to extend in the positive Z direction from a support arm. The support arm can be integral with second metal piece 220 and can extend in the negative X direction from the face of the EM interface. However, in other example embodiments, the support arm can be a supporting structure that can be spatially fixed relative to the second metal piece 220. Moreover, the location of the second wedge and first wedge relative to the second metal device and first metal device, respectively, can vary so long as the location of the two wedges relative to each other can facilitate the two wedges engaging as further describe herein.

In an example embodiment, the first wedge portion 240 can comprise a sloped surface 241 facing away from an interface 290 between the first and second metal pieces. The second wedge portion can comprise a sloped surface 251 facing towards interface 290. The slope of surfaces 241 and 251 can be "matched surfaces" or, stated another way, "complementary angled surfaces." In other words, the slopes of surfaces 241 and 251 can be configured such that as first metal piece 210 can be forced in a negative Y direction the pieces can slide along surfaces 241 and 251 and surface 251 can provide a force against surface 241 that causes first metal piece 210 to initially move and to be forced in a positive X direction. For example, the surface 241 can be sloped at an angle alpha ("α") and surface 251 can be sloped at an angle beta ("β"). In one embodiment angle alpha can be equal to angle beta. Angles alpha and beta can range from 20 degrees to 70 degrees, from 30 degrees to 60 degrees, from 40 degrees to 50 degrees, and in one embodiment can be 45 degrees. Thus, the wedge blocks can be configured to transfer a force through the angled surfaces of the wedge blocks to a direction that can be orthogonal to the direction of the original force direction.

Figure 3:
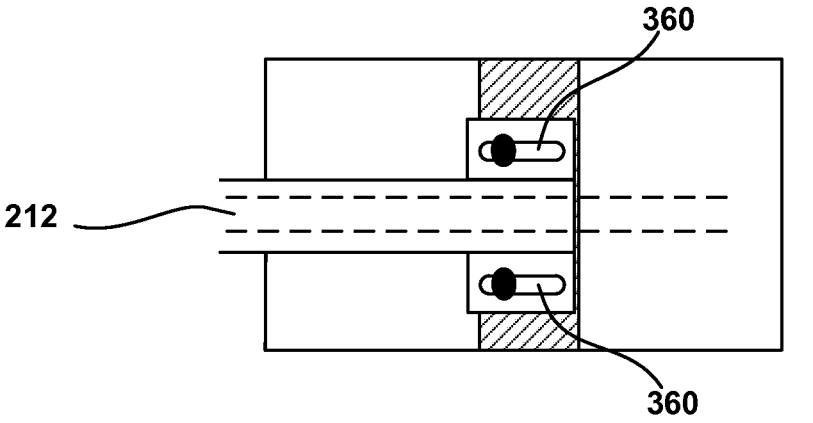

In further example embodiments, a slot hole(s) 360 can be provided through the first metal piece. The depth direction of slot hole 360, in the first metal piece (as shown in FIG. 3), can be oriented in a direction parallel to interface 290. Slot hole 360 can pass through first metal piece 210 on either side of waveguide portion 212. Slot hole 360 can further be of any suitable slot type shape. For example slot hole 360 can comprise a rectangular shape, an oval shape, an oblong, and or the like. Slot hole 360 can have a width direction perpendicular to the interface. In an example embodiment, slot hole 360 can have a width direction in the positive X direction. The dimensions of slot hole 360 can be any suitable dimensions large enough to receive a bolt 270 (as shown in FIG. 2), allow bolt 270 to pass completely through first metal piece 210, and allow bolt 270 to slide within the slot in the negative/positive X direction. Bolt 270 can comprise a smooth portion and a threaded portion. Bolt 270 can further comprise a bolt head for applying a force to the first metal piece. Washers, locknuts or other suitable shoulder elements can further be used. Moreover, bolt 270 can be any suitable fastener configured to apply a force (a direct force and/or a compressive force) causing the first metal piece 210 to be pressed against the second metal piece 220 through transference of that force through their respective wedge blocks.

Second metal piece 220 (for example, "a second component" or "chassis") can further comprise a threaded hole. The threaded hole can be configured to receive the threaded end of bolt 270. The first and second wedge portions can be configured to contact each other when drawn towards each other by a force applied by bolt 270. As bolt 270 is tightened, first metal piece 210 can slide down the slope as well as in the positive X direction until first metal piece 210 is compressed sufficiently against second metal piece 220. The waveguide channels and metal pieces can be machined such that at this point, waveguides 212 and 222 can be substantially in alignment with each other in the immediate vicinity of the interface plane. Stated another way, the angled surfaces of the two wedges can slide along each other until the discontinuity at the mating faces (or interface) becomes acceptable. The two metal pieces can be fixed in place by the component of the force transferred off of the angled surfaces in the direction of the desired mating interface.

In an example embodiment, a first force in a first direction can be transferred, through the first and second force transfer features of the first and second components, to form a second force in a second direction that can be orthogonal to the first direction. The first force can be created by any suitable fastener or other method for applying a force, to a first metal piece, in the negative y direction causing the first metal piece to be clamped to (or forced together) in a positive X direction to the second metal piece.

Figure 4:
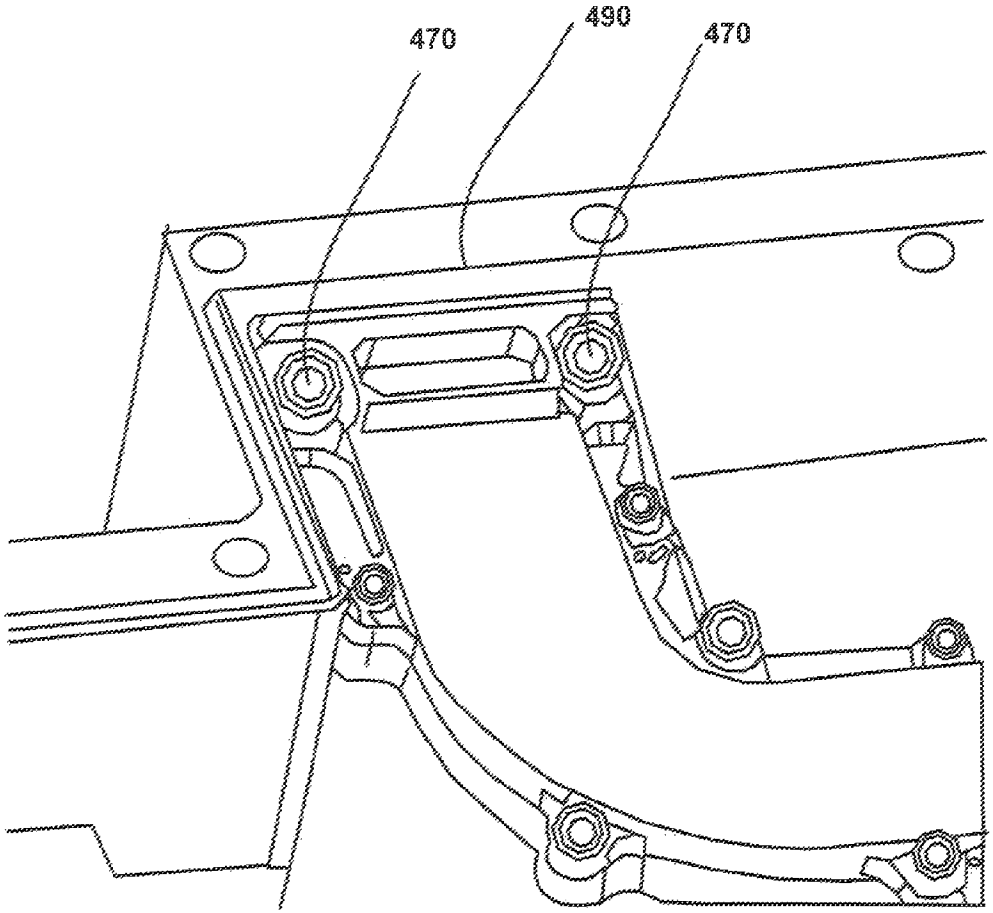
FIGS. 4-7 are various views of an example transmitter comprising an example interface in accordance with various example embodiments.
Figure 5:
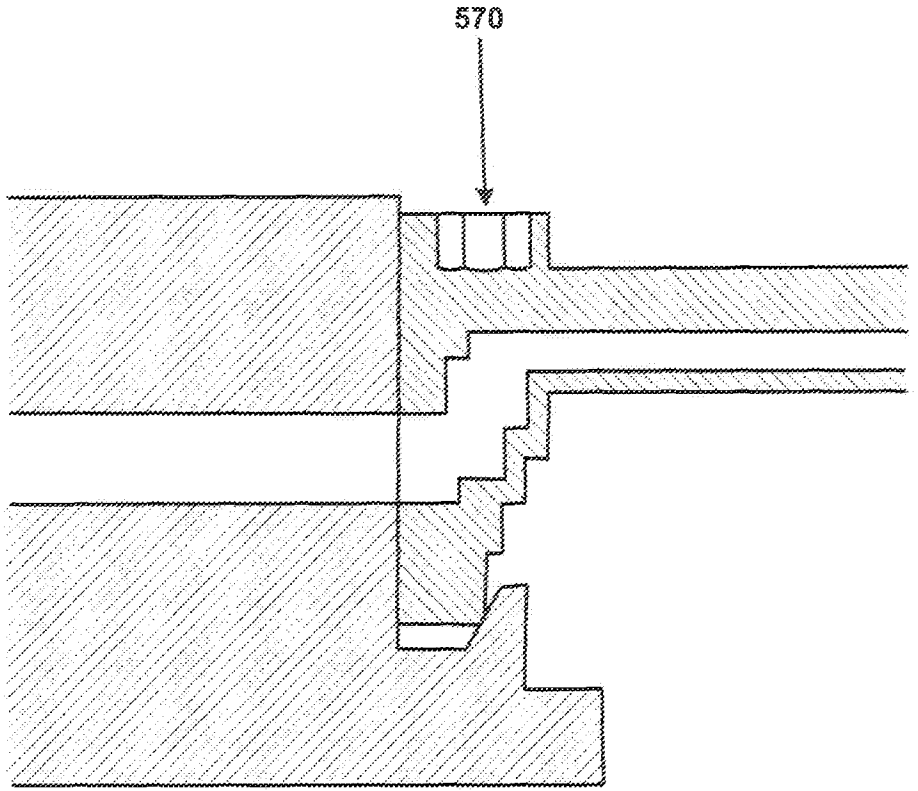

With reference now to FIGS. 4-7, in an example embodiment, a portion of a transceiver is shown with the cover removed exposing the transmit waveguide assembly inside (see FIG. 4). An example of the transmit waveguide/wall interface can be discussed with reference to FIG. 4. In an example embodiment, the hardware (fasteners) 470 (570 in FIG. 5) can be parallel to the interface plane 490. In this example embodiment, an attempt to install such fasteners in an orientation perpendicular to interface plane 490 could be difficult due to space limitations. In contrast, it can be relatively simple to access and manipulate fasteners in an orientation parallel to interface plane 490. A cut-a-way view of the cammed/wedge interface can be seen in FIG. 5. In this example embodiment, the transmit waveguide steps down a few steps before the interface at the wall of the transceiver housing. Nevertheless, the waveguide can have any suitable configuration, be it stepped, curved, straight, etc.

Figure 6:
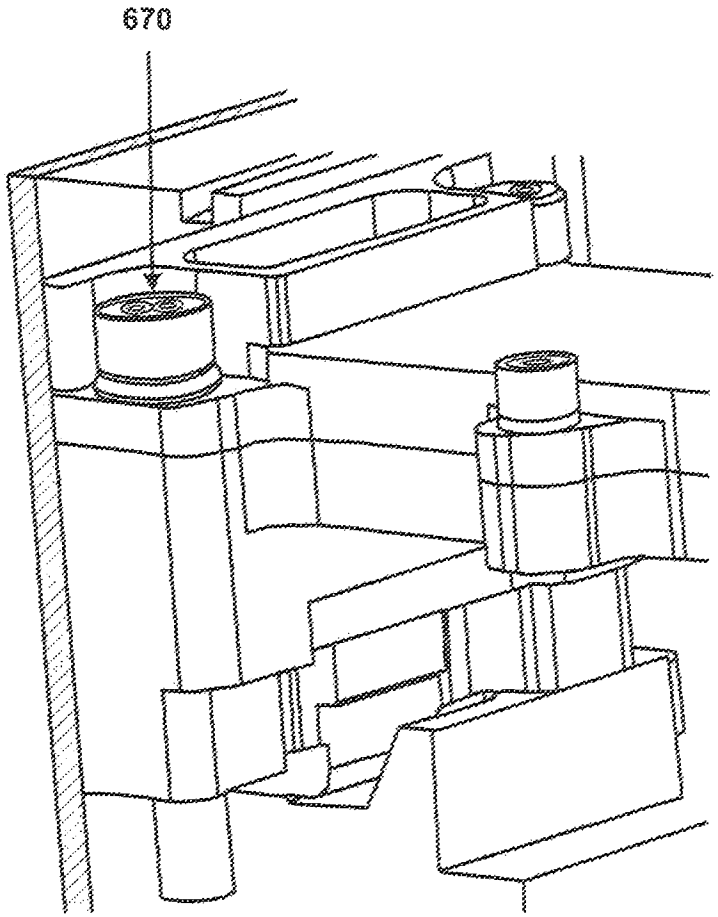
Figure 7:
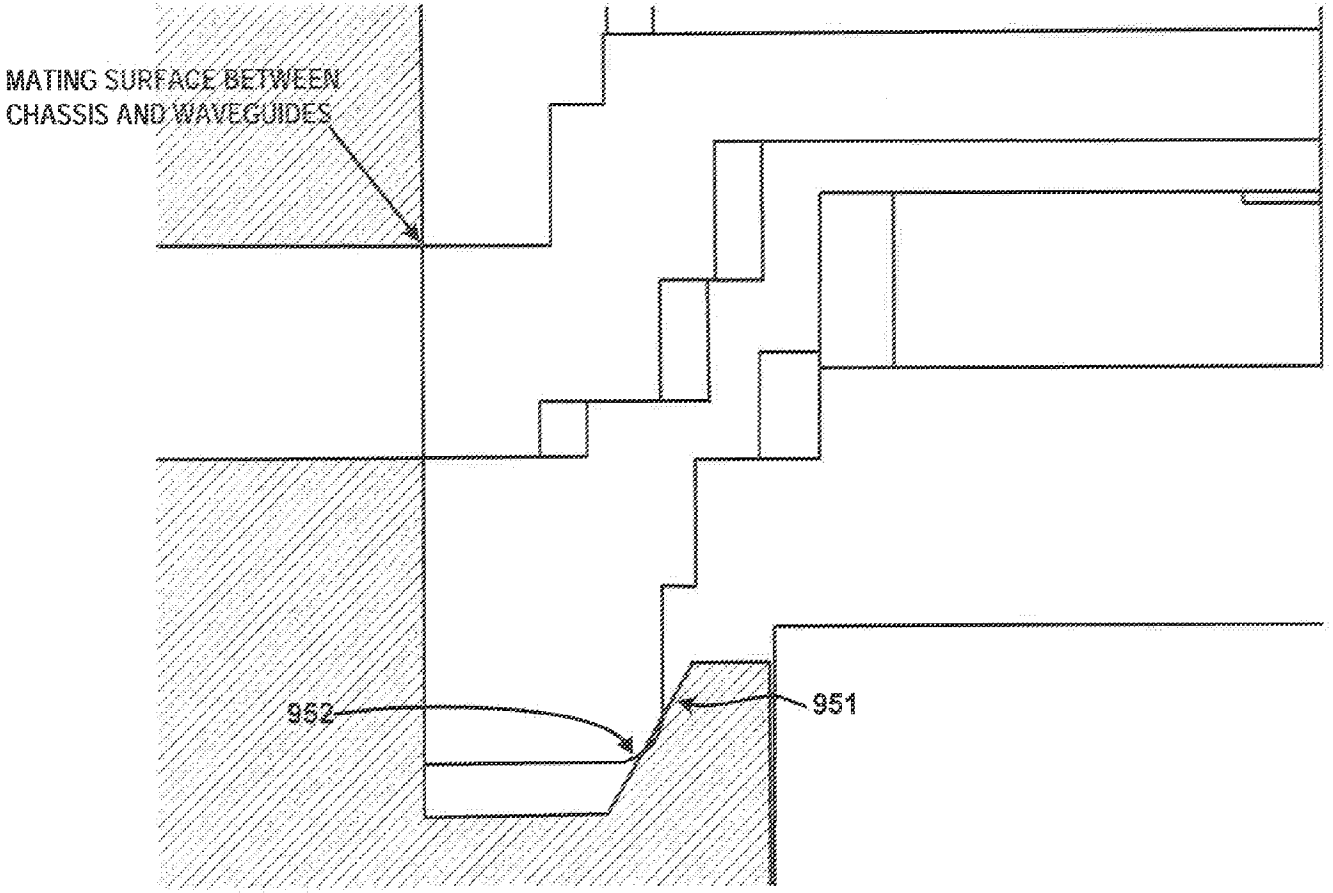

In an example embodiment, and with reference to FIG. 6, the assembly of the waveguide portion and the chassis portion can be held together with fastener 670. In this view, the waveguide piece can comprise a force transfer feature that can be rounded to create a cam motion at the interface. In this example embodiment, tightening the fasteners 670 can be configured so that a cam action pushes the mating faces together. In an example embodiment, the metal portions can be made of aluminum. The aluminum can allow minute flex of the waveguide parts, adding tension and stability to the interface, even during vibration input to the unit. With reference to FIG. 7, an intentional interference can be designed into the size of the parts. For example, the interference between the chassis force transfer feature 951 and the waveguide force transfer feature 952, when in the desired position, can be 0.002 inches. It is noted that FIG. 7 illustrates the mating surface between the chassis and waveguide as a straight line.

Moreover, any suitable method can be used for applying force to the angled surface in a direction orthogonal to the direction of compression in the interface, and thus providing the direct and uniform contact to minimize physical discontinuities at the interface. Moreover, principles described herein can facilitate creating a low profile fitting assembly, wherein the fastener applies three in a direction orthogonal to a 'waveguide' to 'chassis' interface that nonetheless forces the two objects together. The method and device disclosed herein can facilitate forming a contact without fasteners engaging in a direction perpendicular to the interface. This can be useful where physical space constraints and costly machining techniques prevent using direct fasteners or electromagnetic chokes to achieve the low VSWR interface. Also, in an example embodiment, the fasteners can be configured to not engage the second metal piece near the waveguide interface.

It will be understood that the device and method disclosed herein can be used for various waveguide interfaces at any suitable frequency ranges, but can be particularly useful at microwave and millimeter-wave frequencies.

In accordance with an example embodiment, a method of connecting a waveguide to a chassis can comprise the steps of: forming a waveguide with a force transference device; forming a chassis having a second force transference device, wherein the first and second force transference devices comprise complementary sloped surfaces; and applying an indirect compression force to the waveguide, wherein the indirect compression force can be translated through the complementary sloped surfaces to generate a compressive force that holds the waveguide and chassis together. The applying of an indirect compression force can be accomplished using a fastener. In an example embodiment, the fastener can be a bolt. The bolt can be, for example, partially threaded on the end for engaging the chassis.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

Although the invention has been described herein in connection with an interface between a waveguide and chassis, one of ordinary skill in the art will appreciate that the invention is not so limited and includes any waveguide to waveguide connection, and or the like, where a robust connection is desired in a constrained space.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the steps recited in any method claims may be executed in any order and are not limited to the order presented in the claims. Moreover, no element is essential to the practice of the invention unless specifically described herein as "critical" or "essential."

What is claimed is:

1. An electromagnetic interface comprising:

a first component comprising a first waveguide channel, a first interface surface, and a first force transfer feature;

a second component comprising a second waveguide channel, a second interface surface, and a second force transfer feature; and a fastener to force a first surface of the first force transfer feature in sliding engagement with a second surface of the second force transfer feature, wherein the first and second force transfer features interoperate to create an indirect force holding the first interface surface in contact with the second interface surface and holding the first waveguide channel in alignment with the second waveguide channel.

2. The electromagnetic interface of claim 1, wherein the first component is a waveguide and the second component is a chassis.

3. The electromagnetic interface of claim 1, wherein the first force transfer feature comprises a sloped surface relative to the first interface surface, and wherein the first force transfer feature and the second force transfer feature comprise complementary sloped surfaces.

4. The electromagnetic interface of claim 1, wherein at least one of the first force transfer feature and the second force transfer feature is a wedge block.

5. The electromagnetic interface of claim 1, wherein the fastener applies the indirect force in a first direction parallel to the electromagnetic interface causing a second force in a second direction that is perpendicular to the electromagnetic interface, wherein the second force further facilitates holding the first and second components together.

6. The electromagnetic interface of claim 1, wherein the first force transfer feature transfers the indirect force, in a first direction, to a second direction that is orthogonal to the first direction.

7. An electromagnetic interface comprising:

a first component comprising a first waveguide channel, a first interface surface, and a first force transfer feature;

a second component comprising a second waveguide channel, a second interface surface, and a second force transfer feature; and a fastener to force the first force transfer feature in sliding engagement with the second force transfer feature, wherein the first and second force transfer features interoperate to create an indirect force holding the first interface surface in contact with the second interface surface and holding the first waveguide channel in alignment with the second waveguide channel, further comprising a slot hole in the first component, and a threaded hole in the second component, and wherein the fastener is a threaded bolt passing through the slot hole in the first component and engaging the threaded hole in the second component to apply the indirect force.

8. An electromagnetic interface between two components using an indirect force to engage the two components, the electromagnetic interface comprising:

a first force transfer feature in fixed spatial relationship with a first component of the two components; and a second force transfer feature in fixed spatial relationship with a second component of the two components, wherein the first force transfer feature and the second force transfer feature comprise surfaces in sliding engagement with each other;

wherein the first force transfer feature and second force transfer feature convert the indirect force in a first direction into a direct force in a second direction, and wherein the direct force in the second direction causes the first component and the second component to be held together at the electromagnetic interface.

9. The electromagnetic interface of claim 8, wherein the first component comprises a first waveguide channel, wherein the first component has a first interface surface that intersects with the first waveguide channel;

wherein the second component comprises a second waveguide channel, wherein the second component has a second interface surface that intersects with the second waveguide channel; and wherein the first interface surface and second interface surface abut one to the other forming the electromagnetic interface with the first waveguide channel substantially aligned with the second waveguide channel at the electromagnetic interface.

10. The electromagnetic interface of claim 8, wherein the first direction is parallel to a plane representing the electromagnetic interface between the first component and the second component.

11. The electromagnetic interface of claim 8, wherein the indirect force is applied by a threaded fastener, wherein the first force transfer feature comprises a first wedge, wherein the second force transfer feature comprises a second wedge, wherein the threaded fastener drives the first wedge on the first component into the second wedge on the second component, and wherein a sloped surface of the first wedge faces in an opposite direction of a sloped surface of the second wedge.

12. The electromagnetic interface of claim 8, wherein the first and second force transfer features comprise opposing wedges to cause the first component to be forced together with the second component at the electromagnetic interface.

13. The electromagnetic interface of claim 8, wherein the first component is a waveguide and the second component is a chassis.

14. The electromagnetic interface of claim 8, wherein the first force transfer feature transfers the indirect force, in the first direction, to the direct force that is in the second direction that is orthogonal to the first direction.

15. The electromagnetic interface of claim 8, wherein the first and second force transfer features comprise complementary sloped surfaces.

16. The electromagnetic interface of claim 8, wherein the first force transfer feature is integral with the first component, and wherein the second force transfer feature is integral with the second component.

17. A method of connecting a waveguide to a chassis comprising:

forming a waveguide comprising a first force transfer feature;

forming a chassis comprising a second force transfer feature, wherein the first force transfer feature and the second force transfer feature comprise surfaces in sliding engagement with each other; and applying an indirect compression force between the waveguide and the chassis, wherein the indirect compression force is translated through the first and second force transfer features to generate a compressive force that holds the waveguide and chassis together at a waveguide interface.

18. The method of claim 17, wherein the first and second force transfer features comprise complementary sloped surfaces.

19. The method of claim 17, wherein the first force transfer feature transfers the indirect compression force, in a first direction, to the compressive force in a second direction that is orthogonal to the first direction.

20. The method of claim 17, wherein the first force transfer feature comprises a sloped surface relative to the waveguide interface.

21. The method of claim 17, wherein applying the indirect compression force is accomplished by screwing a bolt into the chassis, wherein the bolt is oriented in parallel with the waveguide interface between the waveguide and the chassis.

22. A method of connecting a waveguide to a chassis comprising:

forming a waveguide comprising a first force transfer feature and a slot hole;

forming a chassis comprising a second force transfer feature and a threaded hole; and passing a threaded bolt through the slot hole in the waveguide and engaging the threaded hole in the chassis to apply an indirect compression force between the waveguide and the chassis, wherein the indirect compression force is translated through the first and second force transfer features to generate a compressive force that holds the waveguide and chassis together at a waveguide interface.

* * * * *

UNITED STATES PATENT AND TRADEMARK OFFICE

CERTIFICATE OF CORRECTION

PATENT NO. : 9,035,728 B2
APPLICATION NO. : 13/801078
DATED : May 19, 2015
INVENTOR(S) : Rob Zienkewicz and Mike Potemra It is certified that error appears in the above-identified patent and that said Letters Patent is hereby corrected as shown below:

In the Specification

Column 5, line 26, delete “slopped” and insert --sloped--

Signed and Sealed this
First Day of December, 2015

Michelle K. Lee

Michelle K. Lee
*Director of the United States Patent and Trademark Office*